US005451172A

United States Patent [19]

Lee Siew Suan et al.

[11] Patent Number: 5,451,172

[45] Date of Patent: Sep. 19, 1995

[54] CONNECTOR FOR FLAT CABLES

[75] Inventors: Sally Lee Siew Suan; David C. Martin; Peter C. de Jong, all of Singapore, Singapore

[73] Assignee: The Whitaker Corporation, Wilmington

[21] Appl. No.: 231,551

[22] Filed: Apr. 22, 1994

[30] Foreign Application Priority Data

May 28, 1993 [JP] Japan ..... 5-033798 U

[51] Int. Cl.[6] ..... H01R 9/07

[52] U.S. Cl. ..... 439/495; 439/438

[58] Field of Search ..... 439/267, 266, 268, 329, 439/259, 260, 438–441, 492–495

[56] References Cited

U.S. PATENT DOCUMENTS

| | | | |
|---|---|---|---|
| 3,022,481 | 2/1967 | Stepoway | 439/329 |
| 3,444,502 | 5/1969 | Mathews | 439/329 |
| 4,478,471 | 10/1984 | Olsson | 439/267 |
| 4,555,155 | 11/1985 | Drake | 439/492 |
| 4,576,427 | 3/1986 | Verfruggen | 439/267 |
| 4,734,053 | 3/1988 | Imai | 439/329 |
| 4,778,403 | 10/1988 | Ikesugi et al. | 439/329 |
| 4,936,792 | 6/1990 | Onoue et al. | 439/329 |
| 4,944,690 | 7/1990 | Imai | 439/492 |
| 5,108,308 | 4/1992 | Northcraft et al. | 439/555 |
| 5,188,534 | 2/1993 | Bertho et al. | 439/79 |

FOREIGN PATENT DOCUMENTS

| | | |
|---|---|---|
| 2-120780 | 9/1990 | Japan . |
| 3-33983 | 4/1991 | Japan . |
| 3-22869 | 5/1991 | Japan . |
| 3-266384 | 11/1991 | Japan . |

*Primary Examiner*—David L. Pirlot
*Attorney, Agent, or Firm*—Mary K. VanAtten; Adrian J. LaRue

[57] ABSTRACT

A connector for flat cables 10 comprises basically an insulating housing 20 and contacts 30. The housing 20 has a slot 26 for the insertion of the flat cable 50 and a number of passages 25 for insertion of contacts in communication with the above mentioned slot. The contacts 30 are preferably stamped from a sheet metal material in the form of a V-shape with one end having a soldering tab 38 and the other end having an actuator 36. The actuators 36 are operated by a special bar, thus allowing to insert or to remove the flat cable 50 using very little effort.

9 Claims, 2 Drawing Sheets

CONNECTOR FOR FLAT CABLES

FIELD OF THE INVENTION

This invention relates to electric connectors, especially to connectors for flat cables designed for connection to flat cables or to the conductive pads of flexible circuit boards by means of SMT or some other method.

BACKGROUND OF THE INVENTION

Flat cables made in the form of a plastic film with a number of parallel conductive film strips or flexible circuits (generally referred to below as flat cables) are widely used for connecting the conductive pads of printed circuit boards or for forming connections between such conductive pads and the contacts of electronic components. Due to their light weight, flat cables are used practically in every kind of home and other electronic equipment.

In order to improve the serviceability of the electronic equipment, the connections between the circuit boards and electronic components are usually made by means of flat cables, and since the compactness is an important feature of the electronic equipment, it is necessary to make the connectors as compact as possible.

A number of types of connectors for flat cables have been proposed and implemented. For example, in vertical type connectors for flat cables according to Japanese Utility Model Publication No. 1991-22869 and Japanese Patent Publication No. 1992-65504 a number of tuning-fork-shaped contacts are secured in the housing. One end of the flat cable, together with an insulating slider, is inserted between the tuning-fork-shaped contacts. The slider is used to properly (without bending) guide very thin and flexible cable between the contacts. It also provides for a proper alignment of the conductive film strips of the flat cable and the contact points of the contacts, as well as for a better resistance to the pulling forces, thus resulting in more reliable electrical connections.

In order to obtain a high density low-profile design, horizontal-type connectors for flat cables were proposed in Japanese Utility Model Publication No. 1991-266384 and Japanese Utility Model Publication No. 1990-120780 with elastic tuning-fork-shaped or triangular contacts.

In order to obtain proper insertion of flat cables in the conventional connectors for flat cables mentioned above and in order to obtain a reliable electrical connection by applying a certain pull-out force, it is necessary to use a slider. In other words, the connector must have at least three components (housing, contacts and slider), thus making it difficult to obtain compact and inexpensive connectors for flat cables.

Attempts to avoid the use of a slider in conventional connectors for flat cables has been made; for example, connectors proposed in Japanese Utility Model Publication No. 1991-33983. In this comparatively low-cost connector for flat cables, a free end of the contacts in the form of a cantilevered bridge has a sharp edge. However, it is difficult to design contacts that would provide both for a rather low force required for insertion of the flat cable and for sufficient resistance to the pull-out efforts. Contacts with a sharp edge develop some resistance to pull-out efforts, but when the flat cable is pulled out, they leave scratches on the conductive film strips of the flat cable. Because of this, connectors of such a design are not suitable for applications requiring repetitive insertions and removals of the flat cable from the connector.

One of the ways to solve the above problems consists in providing ample access space for the flat cable to accommodate a rotating insulating cover pressing on the cantilevered bridge type contact during insertion in or removal of the flat cable from the connector. Examples of such a solution are disclosed in U.S. Pat. Nos. 4,944,690 and 4,936,792. Use of a hinged or pivoted cover is very effective whereby neither cable nor contacts become damaged and the cable insertion requires only low or no effort, while providing for a reliable electrical connection between the conductive film strips of the flat cable and the contacts of the connector.

On the other hand, such a rotating cover represents a disadvantage because it makes the manufacturing of connectors for flat cables more difficult and cost-extensive. Another disadvantage consists in the fact that the design and operation of the connectors with rotating cover are complicated, because the cover should be positively fixed and difficult to open.

Therefore, the purpose of this invention is to offer a connector for flat cables which consists basically of two parts and is easy in manufacturing and use.

SUMMARY OF THE INVENTION

In order to eliminate the above mentioned disadvantages of the conventional connectors for flat cables and to achieve the purposes stated above, the connector for flat cables according to this invention has no slider and comprises basically two parts, namely, an insulating housing member and contacts. The contacts are stamped from metal sheet material having suitable spring characteristics in the shape of V; one end is used for termination such as soldering, and the other end is a flat piece with an actuator. The contacts are inserted in the contact-receiving passage of the insulating housing member which is connected with the slot into which one end of the flat cable is inserted.

In order to make connection of the flat cable with the contacts inside the housing or to disconnect it therefrom, the connector is equipped with a simple device making it possible to simultaneously press all contact actuators protruding from the housing body; an ample space is provided between the upper wall of the slot and the contact points of the contacts for the movement of actuators. Since this operation makes it possible to insert the flat cable in or to remove it from the connector using only very small effort, no damage to the conductive film strips or to the contacts takes place.

A connector for flat cables comprising, an insulative housing member having a slot along a long side of the housing member and a number of passages in communication with the slot, contacts disposed in the passages and comprising an upper arm and a lower arm connected together at one of their ends, said upper arm extending exteriorly from said housing member and including an actuator and a contact member, said actuator being used to lower the contact member for insertion or removal of the flat cable into and out of the slot, the lower arm extending exteriorly from the housing member and including a projection for securing the contact in the passage and a free end for electrically connecting to a printed circuit board.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
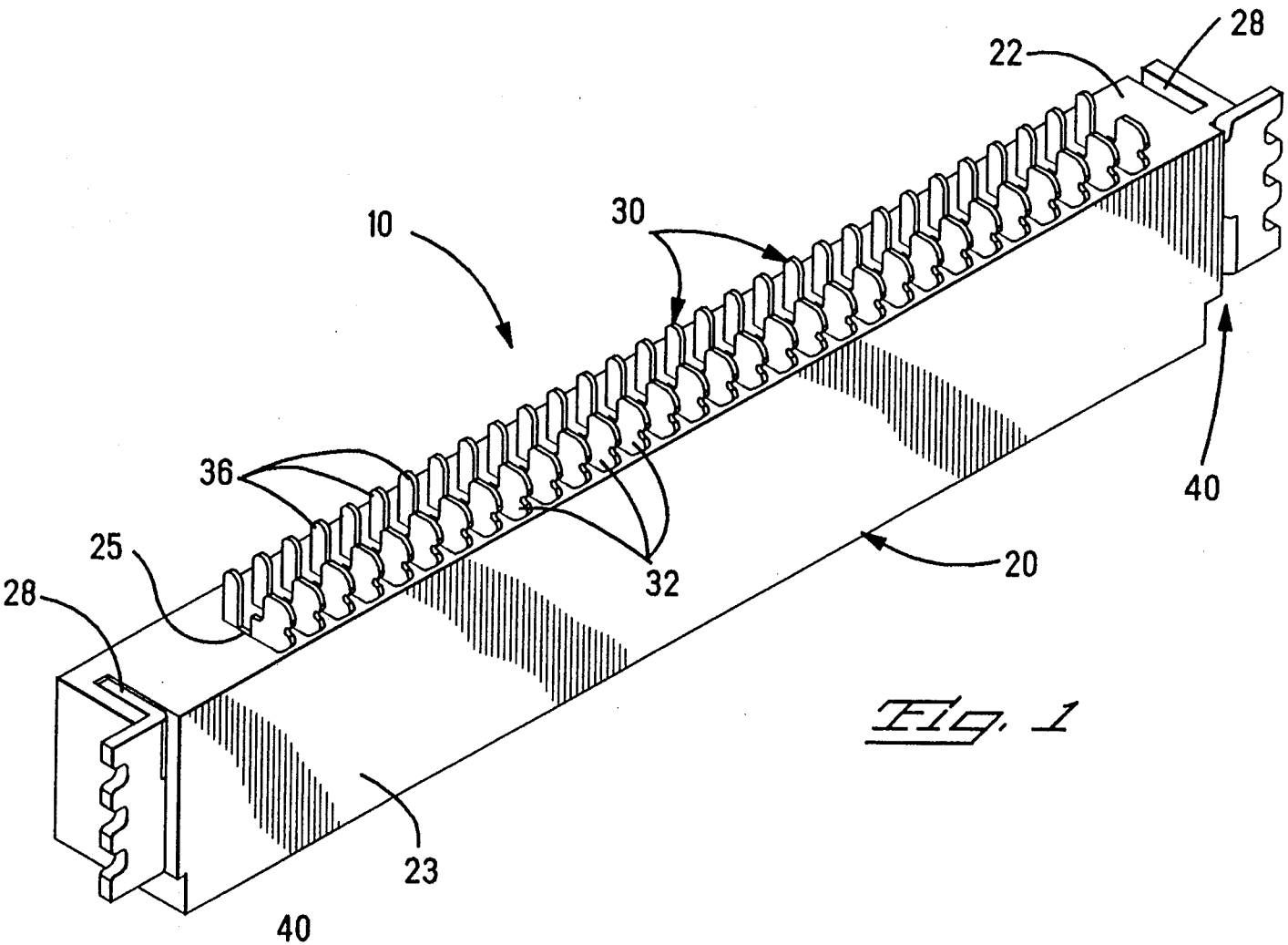
FIG. 1 is a perspective view of the preferred embodiment of the connector for flat cables according to this invention.

FIG. 1 is an perspective view of the preferred embodiment of the connector for flat cables 10 according to this invention. As it becomes clear from the FIG. 1, the connector for flat cables 10 of this embodiment consists of an elongated insulating housing 20 with a number of contacts 30 arrayed along the long side of the housing 20 at a predetermined pitch. Two retaining legs 40 made as an L-shaped metal part are pressed and secured in slots 28 located at both ends of the housing 20.

As it will be explained in more detail below, roughly V-shaped contacts 30 are made by stamping from a sheet of a beryllium-copper alloy, a phosphorous bronze or other copper alloy having required spring characteristics. The contacts 30 are inserted with their closed ends (the bend) 32 to the front into the contact-receiving passage 25 which extends perpendicular to the longer side of the housing 20 between the front surface 21 and the back surface 22 of the insulating housing 20. The closed end 32 of the contact 30 is spaced from the front surface 21 of the housing 20, and both free ends extend beyond the back surface 22 of the housing 20.

Figure 2:
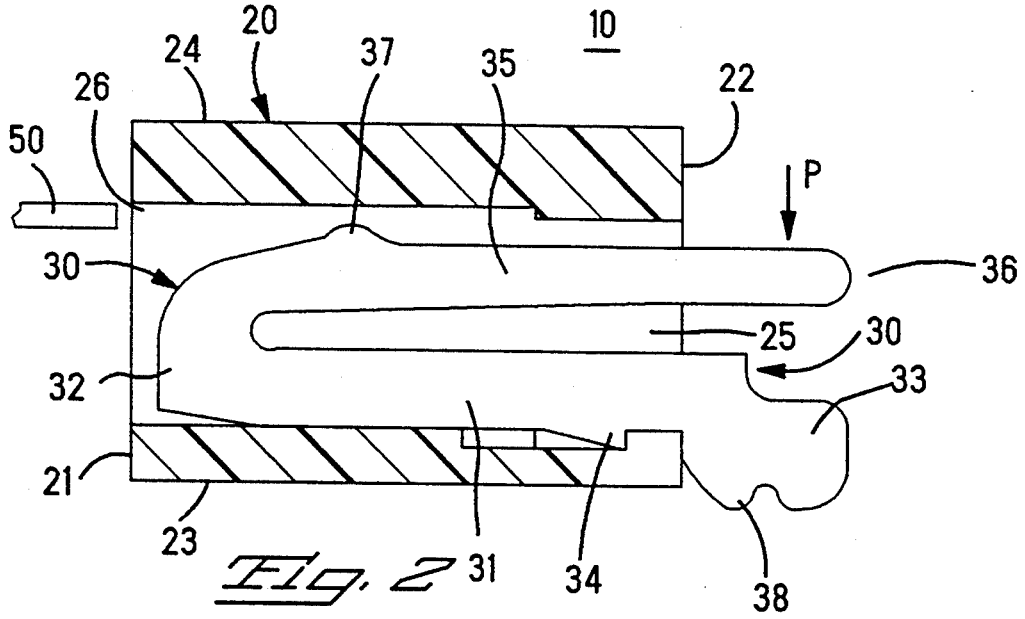
FIG. 2 shows a cross-sectional view of the connector for flat cables shown in the FIG. 1.

FIG. 2 is a cross sectional view of the connector 10 for flat cables shown in the FIG. 1. The contacts 30 are inserted with the closed end 32 being first from the back surface 22 of the housing 20 toward the front surface 21. As it was mentioned above, the contact 30 is a V-shaped form with a straight lower arm 31 and an inclined upper arm 35 in the form of a cantilever.

The free end 33 of the lower arm 31 of the contact 30 extends from the back surface 22 of the housing 20 and slightly from its bottom surface, thus forming a soldering tab 38 for surface mounting. This soldering contact 38 can be shaped in a wave form suitable for reflow soldering which makes it possible to obtain a strong fillet. The contact 30 can be secured in the contact-receiving passage 25 of the housing 20 by means of a projection 34 formed at the bottom edge of lower arm 31, projection 34 is disposed in a recess 27 of housing 20.

At the upper edge of the upper arm 35 of the contact 30, at some distance from the closed end 32, a contact member 37 may be made if necessary for forming connection with the conductive film strips (not shown in the drawing) of the flat cable 50 inserted into the slot 26. The free end of the upper arm 35 extends from the back surface 22 of the housing 20 and forms the actuator 36. This actuator 36 can be pressed down in the direction indicated by the arrow P. This pressure is applied when the contact 30 is inserted into the contact-receiving passage 25 of the housing 20 and when flat cable 50 is inserted in or removed from the slot 26.

The two retaining legs 40 have a relatively large flat area roughly in the same plane as the bottom surface 23 of the housing 20. These retaining legs 40 are used to fix the connector 10 to the printed circuit board (not shown in the drawing) by means of soldering to a metal pad using a reflow soldering method. The retaining legs provide reinforcement and prevent soldered connections of the soldering tabs 38 to the printed circuit board also via reflow soldering method from damage (for example, from cracking) when flat cable 50 is inserted in the slot 26 of the connector 10.

As becomes clear from FIG. 2, when the actuator 36 of the contact 30 is pushed down, the contact member 37 of the upper arm 35 is also lowered, and the space between the contact member and the upper surface of the cable-insertion slot becomes larger. Therefore, the effort required to insert or to remove the flat cable 50 is greatly reduced or even becomes equal to zero.

Figure 3:
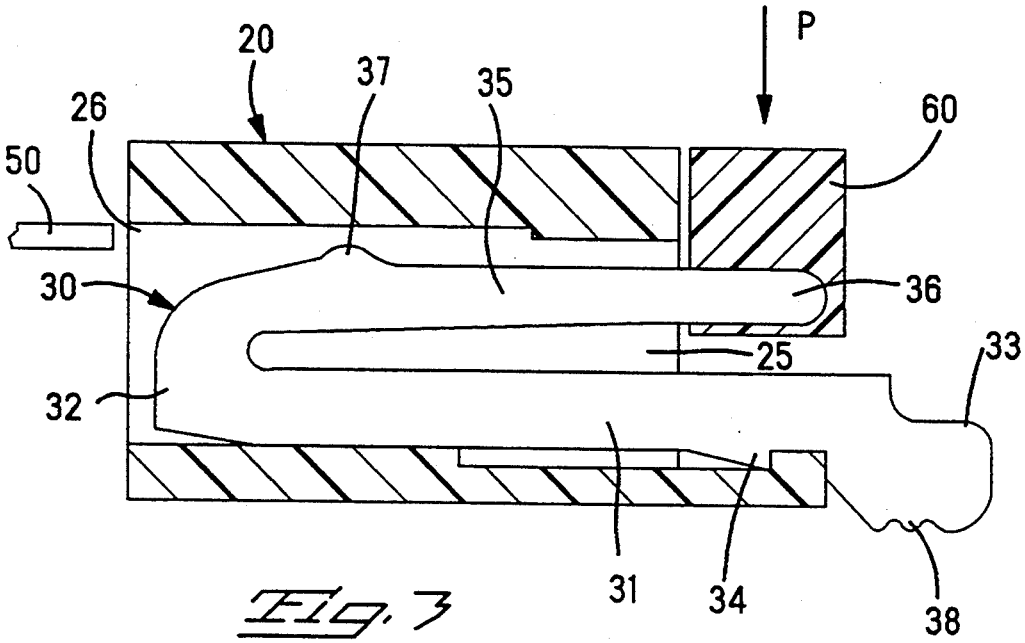
FIG. 3 shows a cross-sectional view of a modified embodiment of the connector for flat cables according to this invention shown in the FIG. 2.

In the embodiment shown in FIG. 2, actuators 36 of the contacts 30 are separate from each other, and for their simultaneous operation it is necessary to use a flat bar. However, these actuators 36 can be provided with a common actuator bar 60 before assembly as shown in FIG. 3. This actuator bar 60 may be insert molded to the contacts. In addition, in order to make possible visual examination of the soldered connections of the soldering tabs 38 made by the reflow method, it is desirable to shorten upper arms 35 and shift the actuator bar 60 slightly to the rear surface 22. Since in this modified embodiment, it is possible to insert a number of contacts 30 in the contact-receiving passage 25 of the housing 20 at once, making the assembly process easier.

The above explanations were based on preferred embodiments of the connector for flat cables according to this invention, however it must be understood that this invention is not limited to only these embodiments, but also can include its various modifications. For example, the soldering tabs of the contacts may be designed for through holes rather than for surface mounting. The contacts need not necessarily be V-shaped, but may be of any variation provided that the actuators are operable. The contacts also should be necessarily flat, but, especially if there are no stringent requirements from the standpoint of density, may be stamped from a sheet material and bent to a desired shape.

As follows from the above explanations, the connectors for flat cables according to this invention, comprise basically two parts: insulating housing and contacts; because of this feature, they are compact and easy and inexpensive in production. Since insertion or removal of the cable requires little or no effort, neither contacts nor flat cables become damaged, thus making it possible to insert and remove the cable many times. Due to the possibility of operating all contact actuators simultaneously using a simple device, the connector according to this invention is easy in operation.

I claim:

1. A connector for flat cables comprising, an insulative housing member having a front surface and a back surface opposite to said front surface, a slot disposed along said front surface, and a number of passages disposed along said back surface in communication with the slot, contacts disposed in the passages and comprising an upper arm and a lower arm connected together at one of their ends, said upper arm including an actuator end and a contact member, said actuator end extends beyond the housing member from said back surface, said lower arm includes a projection for securing the contact in said passageway and a free end extending beyond the housing member from the back surface for providing electrical connection to a circuit board, said actuator end being used to lower said upper arm for insertion or removal of the flat cable into and out of the slot.

2. A connector as claimed in claim 1, wherein said housing member includes retaining legs for securing to a circuit board.

3. A connector as claimed in claim 1, wherein said contact is in a V-shape.

4. A connector as claimed in claim 1, wherein said actuator ends connected together by an actuator bar.

5. A connector as claimed in claim 1, wherein said free end is a soldering tab.

6. A connector as claimed in claim 1, wherein said projection secures said contact by inserting into a recess.

7. A connector as claimed in claim 1, wherein said actuator ends are encased in an actuator bar, said actuator bar connecting said contacts together.

8. A connector as claimed in claim 7, wherein said actuator bar is disposed adjacent to, but spaced away from, the back surface.

9. A connector as claimed in claim 8, wherein said free ends of said lower arm extends from the housing member further than said actuator bar, thereby allowing inspection of the electrical connection to the circuit board.

* * * * *